United States Patent [19]

Beaulieu

[11] Patent Number: 4,991,813

[45] Date of Patent: Feb. 12, 1991

[54] FRAMELESS PORTABLE DISPLAY

[75] Inventor: Bryan J. Beaulieu, Burnsville, Minn.

[73] Assignee: Skyline Displays, Inc., Burnsville, Minn.

[21] Appl. No.: 492,974

[22] Filed: Mar. 13, 1990

[51] Int. Cl.[5] ..... A47F 1/14

[52] U.S. Cl. ..... 248/469; 248/174

[58] Field of Search ..... 248/469, 165, 174; 40/600, 606, 610, 559

[56] References Cited

U.S. PATENT DOCUMENTS

| | | | |
|---|---|---|---|
| 1,656,341 | 1/1928 | Smith | 248/174 X |
| 1,684,753 | 9/1928 | Zareko | 248/174 X |
| 3,231,996 | 2/1966 | Krauss | 248/174 X |
| 3,559,814 | 2/1971 | Downing | 248/174 X |
| 3,837,719 | 9/1974 | Barron | 248/174 X |
| 4,102,524 | 7/1978 | Albano | 248/165 X |
| 4,607,817 | 8/1986 | Aquino | 248/165 X |
| 4,642,946 | 2/1987 | Koch | 40/606 X |

*Primary Examiner*—Gary L. Smith
*Assistant Examiner*—Michael J. Milano
*Attorney, Agent, or Firm*—Paul L. Sjoquist

[57] ABSTRACT

A lightweight portable display support incorporating a display panel, including two vertical support columns, each column formed of two sections of elongated flexible material, typically plastic, wherein one section of material has a width dimension larger than the second section of material, both sections of material having an attachment device extending along their respective elongate edges to cause the wider section of material to bow outwardly when attached to the narrower section, and including an overhead horizontal beam supported between the two vertical support columns, the beam being constructed substantially the same as the respective vertical columns.

24 Claims, 4 Drawing Sheets

FRAMELESS PORTABLE DISPLAY

BACKGROUND OF THE INVENTION

The present invention relates generally to exhibit display systems, and more particularly to the field of lightweight portable frames for supporting exhibits while on display.

The field of portable exhibit display structures has expanded rapidly in recent years meeting the needs for providing truly portable structures of lightweight material which may be readily transported from place to place and quickly erected for display purposes. One such structure is disclosed in my U.S. Pat. No. 4,658,560, issued Apr. 21, 1987, wherein a multiplicity of lightweight struts are triangulated for rigidity and combined with a number of vertical channel members to form a structure for hanging display sheets serving as a display surface. Although the frame structure itself is extremely lightweight and incapable of supporting significant vertical loading, the channel members do provide some vertical rigidity for supporting limited loading. After panels are hung on this structure to form a display, it has the appearance of a curved wall and is even suggestive of solid-wall construction, even though it actually has only limited supportive strength. The display structure may be used to support lights, shelving, and various types of hanging brackets, if the vertical loading is kept within the predefined limits of the structure.

Since portable display structures function primarily to provide a pleasing visual perception and presentation, considerable effort is made to select display panel materials which will enhance this visual perception. Lighting and surface textures are also associated with the display and selected to enhance the visual perception.

While providing the proper visual perception of the display is difficult when applied to a fixed position display, it becomes exceedingly difficult when the display unit must be disassemblable both rapidly and into small enough shipping units for shipment as luggage and readily reassemblable at a distant location. For these reasons the display structure typically incorporates a plastic sheet material, frequently having a fabric covering, which may be readily rolled up for deposit in the storage container. While this allows ready storage and shipment of the display panels, the separate frame structure and components must also be collapsed or disassembled for storage, adding to the quantity of carrying cases that must be transported to a distant location.

The present invention provides an improvement to the display structures of the foregoing types, by further enhancing the perception of strength and beauty while in the erected condition, and additionally providing a lightweight frameless supporting structure which is formed from the display panels themselves.

SUMMARY OF THE INVENTION

The present invention provides an improvement in support structures for supporting a portable display. The invention is formed of a flexible material which is adapted for storage, and which can be quickly assembled into a portable display. A first elongate sheet of a flexible material is attached to a second elongate sheet of flexible material, wider than the first sheet, along the elongate and parallel edges respectively. When so attached, the first sheet remains planar and the second sheet bows outwardly away from the first sheet creating an elongate column having one flat surface and a second curvilinear surface. The elongate column thus formed has the capacity to support substantial vertical loading and retain its three-dimensional stability while supporting a display panel attached along at least one of the elongate edges thereof. Because the column is formed entirely of lightweight flexible material, it may be readily disassembled and rolled for storage or transport. When two such columns are attached to the respective ends of a display panel, they provide support for the panel in an either curved or straight position while providing the appearance of strength and rigidity.

It is the principal object of the present invention to provide a lightweight and readily portable display panel support column having the appearance of strength and rigidity, constructed from plastic sheet materials.

It is another object of the present invention to provide a lightweight support column constructed from plastic materials which may be readily adapted for use with numerous display panels.

It is another object of the present invention to provide a lightweight support structure readily attachable to a portable display panel.

It is another object of the present invention to provide a lightweight support structure constructed from plastic sheet materials having three-dimensional stability when assembled.

It is another object of the present invention to provide a lightweight support structure constructed from plastic sheet materials having the appearance of mass and strength when viewed.

It is a further object of the present invention to provide a lightweight support structure for attachment to portable display panels wherein translucent plastic sheet materials are used to permit backlighting to be applied to the structure to display graphic information printed upon the support structure.

DESCRIPTION OF THE DRAWINGS

The foregoing and other objects and advantages will become apparent from the following specification and claims, and with reference to the appended drawings in which:

FIG. 2 is an overhead view of the structure shown in FIG. 1;

FIG. 3 shows a view of the top portion of one column of the invention;

FIG. 7 is a partial perspective view showing the attachment of the one end column to a table top or the like.

DESCRIPTION OF THE PREFERRED EMBODIMENT

Figure 1:
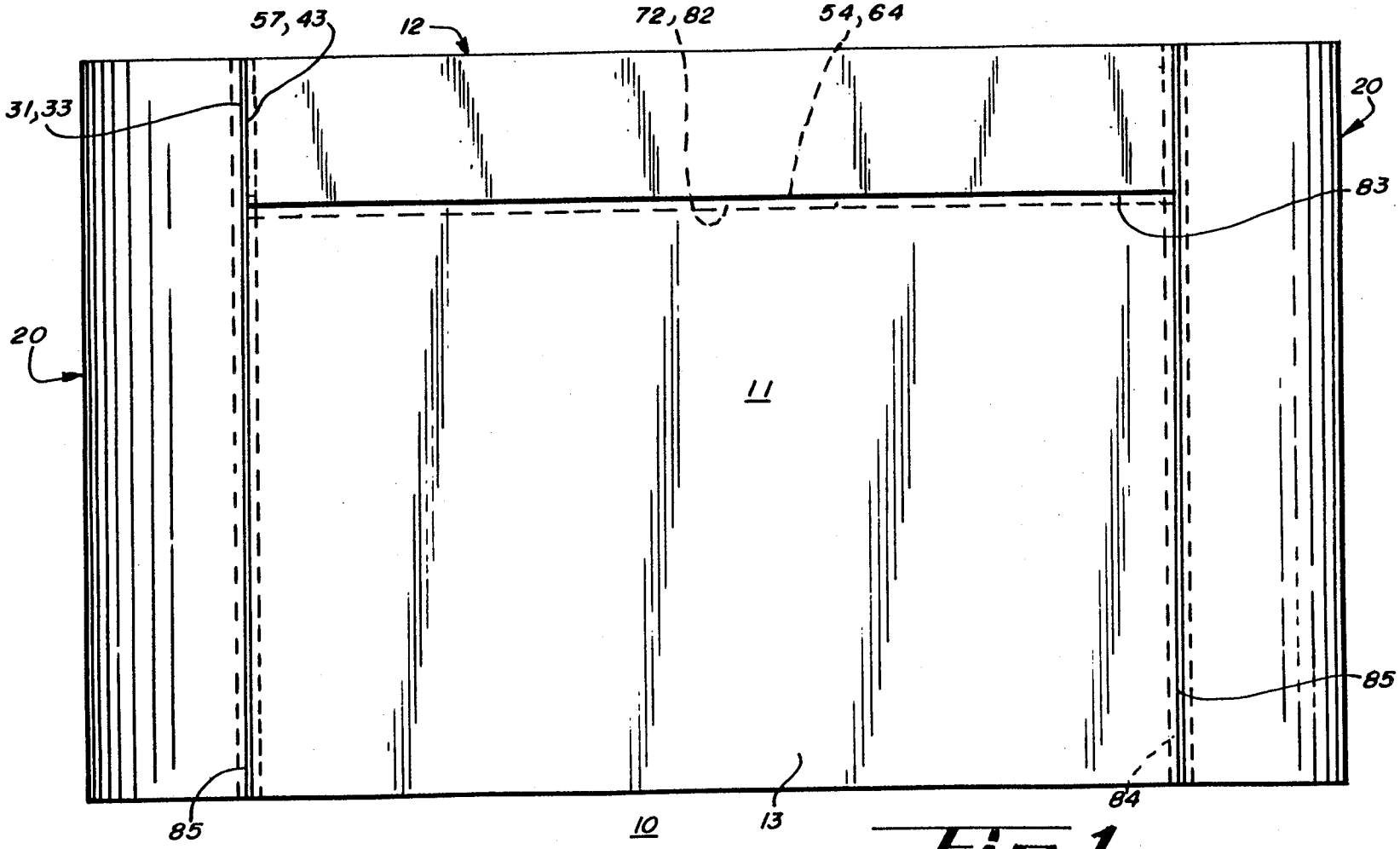
FIG. 1 shows an elevation view of a display panel supported by two of the support structures located at each panel end.
Figure 5:
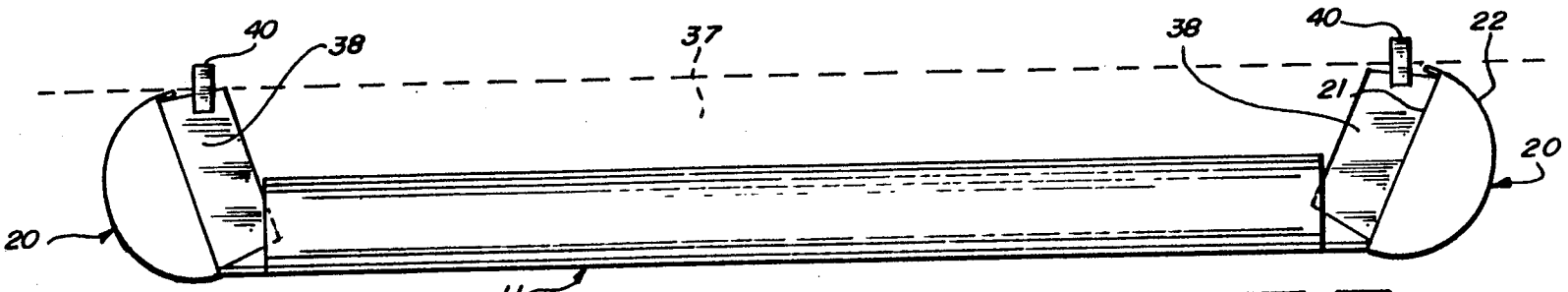
FIG. 5 shows an enlarged rear view taken approximately at 5—5 of FIG. 4.

Referring to the drawings, a portable display structure generally shown at 10 has a display surface 11 and have a support column 20 located at its each end, with an upper column 12 between columns 20. The display structure 10 is self-supporting, and may be placed upon any suitable surface such as a floor or a table top. The display surface 11 is connected to upper column 12 and between support columns 20, to define an area where the user may display selected information.

Each support column 20 is constructed of a flexible material, preferably a plastic sheet. The support column 20 may be constructed of a single sheet of plastic material, but is preferably constructed of two sections for forming a planar front sheet 21 and a curved rear sheet 22 attached together along their elongate edges. Each of the sheets 21, 22 is an elongate rectangular sheet of a plastic material; the width of the rear sheet 22 is greater than the width of the front sheet 21 so that the rear sheet 22 bows outwardly from the front sheet 21, thereby adding vertical rigidity to the support column 20. The sheet material of the front sheet 21 and the rear sheet 22 may be separately selected to optimize their respective physical and aesthetic properties.

Figure 4:
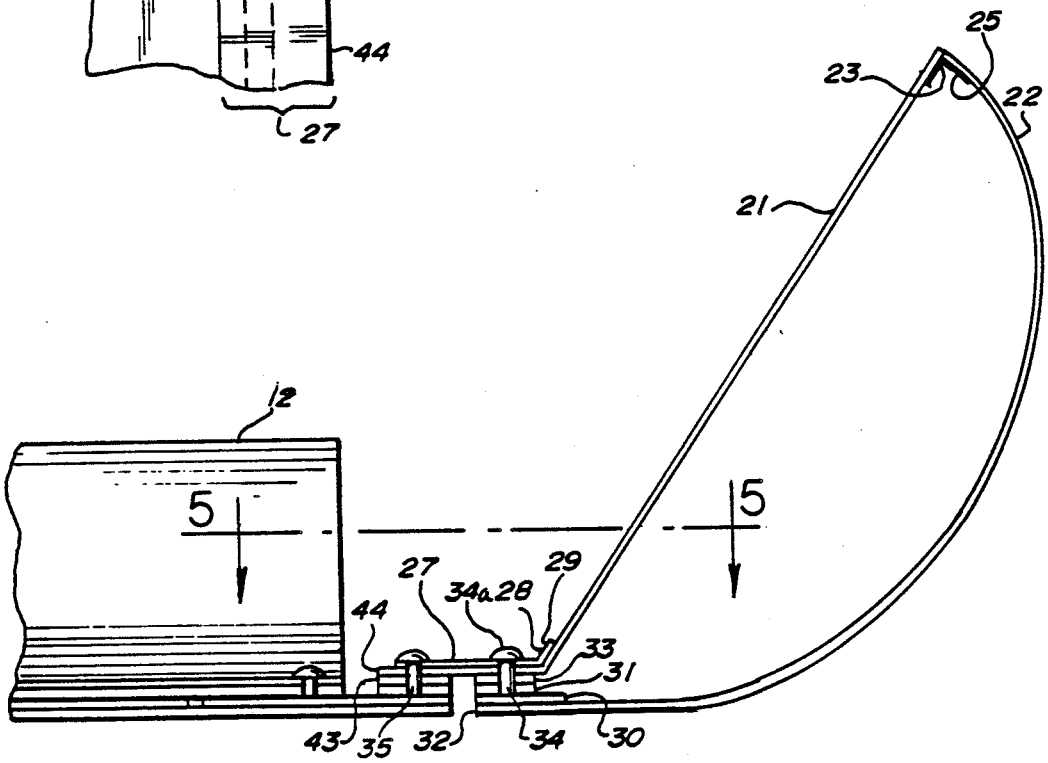
FIG. 4 shows a detailed overhead view taken at the junction of one column and the beam.
Figure 8:
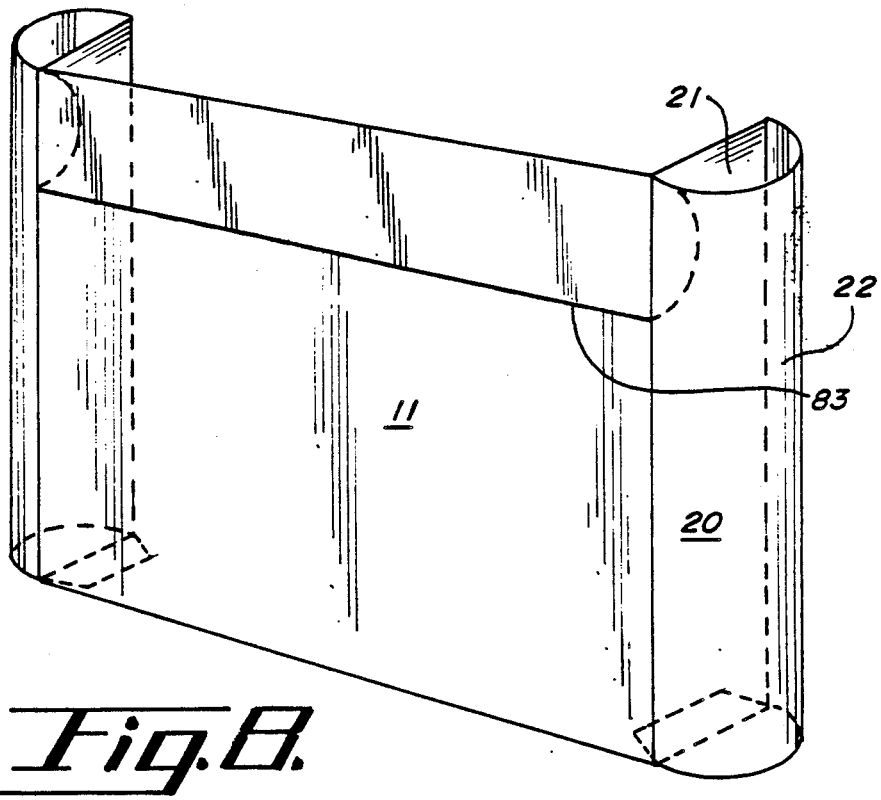
FIG. 8 is an overall perspective front view of the invention.
Figure 7:
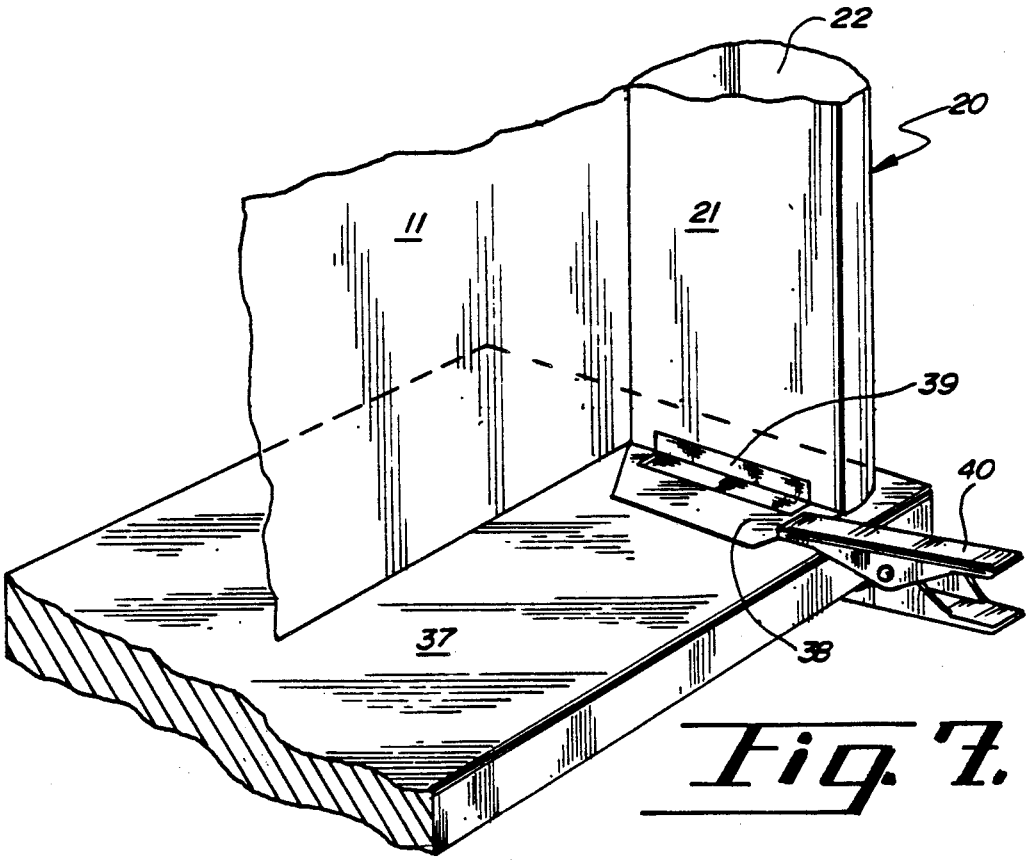

Referring to FIG. 4, the first edge 23 of the front sheet 21 is hingedly affixed adjacent the first edge of the rear sheet 22 using a tape hinge 25. The tape hinge 25 runs along a hinge line. The front sheet has a second hinge 28 which forms an edge strip 27, supported by a second tape hinge 29. The top edge of edge strip 27 is notched in two places 36 to receive locating pins 34 and 35.

The front sheet 21 and the rear sheet 22 may be joined using any suitable detachable connection means holding the rear sheet 22 abutting the edge strip 27. One such system involves the combination of mechanical and magnetic connectors. A first metallic plate 30 is affixed along the inner surface of the rear sheet 22 abutting in parallel the second elongate edge 32 of the rear sheet 22, and supporting a locating pin 34. A magnetic strip 31 is affixed along the inner surface of rear sheet 22 in parallel to edge 32. A second magnetic strip 33 is affixed along the inner surface of edge strip 27, and the two magnetic strips 31, 33 cooperate to hold edge strip 27 against rear sheet 22. To further ease the assembly and stabilize the joint a locater pin 34 is affixed to metallic plate 30. Locater pin 34 has a large diameter head **34*a* affixed thereon. The locater pin head 34*a* is disposed a distance from plate 30 approximately equal to the thickness of the magnetic strips 31 and 33 and the connecting strip 27. The connecting strip 27 has mating U-shaped slot 36 formed along its upper edge to receive the locater pin 34. In an alternate form of the edgewise attachments of the sheets 21, 22, hook-and-loop fasteners commonly known as "Velcro®" fasteners may be substituted for the respective magnetic strips 31 and 33**.

Since the rear sheet 22 is necessarily and inherently of wider dimension than the front sheet 21, the foregoing edgewise attachment will create an outward bow in sheet 22. This outward bowing forms a geometric cross section such as is shown in FIG. 4, and provides dimensional stability to the support column 20 allowing the attachment and support of the upper column 12 attached thereto. Edge strip 27 has a second magnetic strip 43 affixed thereto, facing inwardly in the same sense as magnetic strip 33. Magnetic strip 43 is attached adjacent to and along a second edge 44 of sheet 21. Magnetic strip 43, along the upper part of its length, is used to hold upper column 12 in position; magnetic strip 43, along the lower portion of its length, is used to hold a vertical edge of display panel surface 13 in position.

In some applications it is advantageous to removably attach the display structure 10 to a support surface 37, such as a table top. By making such an attachment, the stability of the display structure 10 is enhanced. It is preferable to provide a hold down by attaching a hold-down flap 38 using a tape hinge 39 at the base of the front sheet 21 of an end column 20. As so attached, the hold-down flap 38 may flex along the tape hinge for storage, or may be folded out essentially perpendicular to the front panel 21 for attachment to a support surface 37. By providing a substantial surface area on the hold-down flap 38 the entire display structure may be stabilized by clamping the hold-down flap 38 to the support surface 37 using a suitable clamping device, such as a spring clamp 40.

Figure 6:
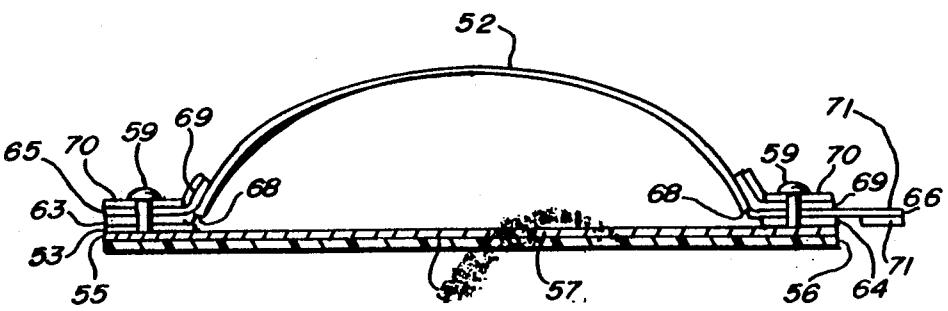
FIG. 6 shows a partial cross-sectional end view of the upper panel being taken approximately at 6—6 of FIG. 5.
Figure 7:
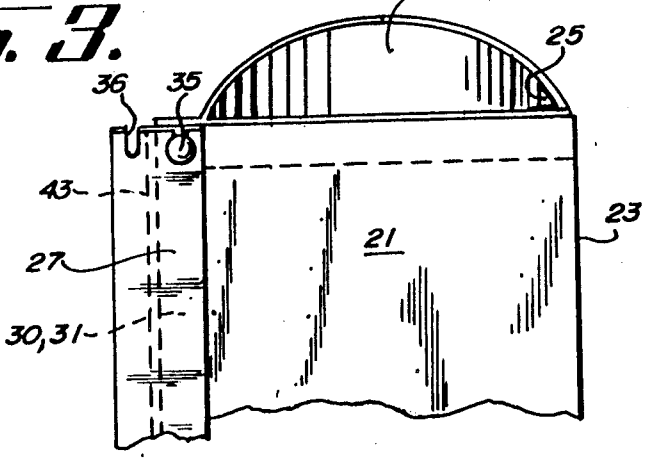
Figure 5:
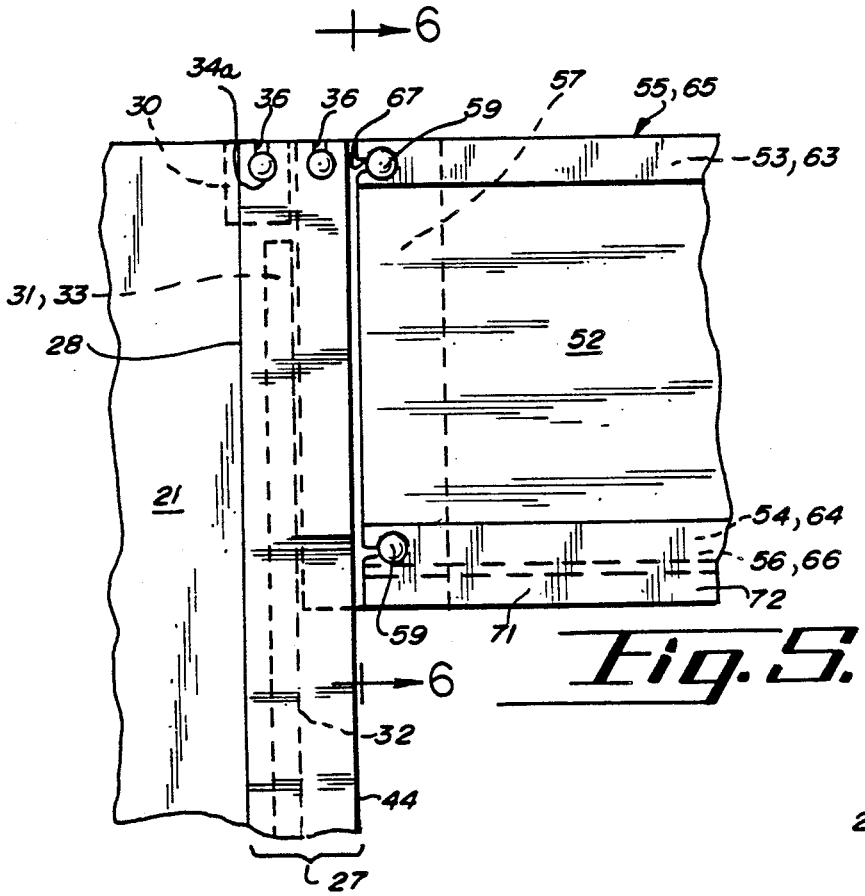

The upper column 12, as more clearly shown in FIG. 6, has an elongate rectangular planar front sheet 51 and an elongate rectangular curved rear sheet 52 joined together along the respective elongate edges to form the column cross section shown in FIG. 6. The upper column front sheet 51 is a rectangular panel, preferably formed of plastic, having magnetic attachment strips 53, 54 attached along its first and second elongate edges 55, 56 respectively. The stiffener strip 57 is located along the shorter edges of the upper column front sheet 51. The stiffener strip may be any suitable rigid material.

The upper column rear sheet 52 similarly consists of an elongate rectangular piece of a flexible material such as a plastic. Located along the first elongate edge 65 and adjacent the second elongate edge 66 of the rear sheet 52 are the first and second magnetic strips 63, 64.

In its assembled form, the rear sheet 52 is attached along its first elongate edge 65 to the first elongate edge 55 of the front panel. The respective first magnetic strips 53, 63 are placed in intimate contact thereby retaining the respective first elongate edges 55, 65 adjacent each other along their length. A locator pin 59 is located proximate the end of each of the elongate edge 55 of the front panel 51 and mates with a U-shaped recess 67 extending inwardly from the end of the first edge 65 of the rear sheet 52. The locator pin 59 has its head extending upwardly from the surface of the stiffener strip 57 a distance approximately equal to the total edge thickness of the rear sheet 52. The attachment of the respective first magnetic strips 53, 63 along their length is done along a hinge line along the rear sheet 52. This is controlled and enhanced by inclusion of a hinge groove 68 inwardly adjacent the first magnetic strip 63. However, the hinge groove 68 weakens the rear sheet 52 therealong and it is advantageous to reinforce the rear sheet using a tape hinge 69 extending along its first elongate edge 55 and overlying the first magnetic strip 63. It is further advantageous to place a reinforced corner hinge 70 at the ends of the tape hinge 69 to further reinforce the ends of the first elongate edge 65 in the vicinity of the locator pin 59.

The second elongate edge 56 of the front sheet 51 is attached inwardly adjacent to the second elongate edge 66 of the rear sheet 52 by mating the second magnetic strips 54, 64 along their length. Since the width of the rear sheet 52 is necessarily inherently greater than the width of the front sheet 51 this causes the rear sheet 52 to bow outwardly therefrom, as shown in FIG. 6, and providing an inherent structural strength along the length of the top column 12. The ends of the second elongate edge 66 of the rear sheet 52 are further stabilized with a locator pin 59 extending from the surface of the stiffener strip 57 and fitting into the U-shaped grooves 67 formed therein. The mating of the respective second magnetic strips 54, 64 along a hinge line causes a bending of the rear sheet 52 inwardly adjacent thereto. The bending is localized and stabilized using a hinge groove 68 located therealong and the weakness caused by the hinge groove 68 is overcome by overlying the bending area with a tape hinge 69 extending along the second elongate edge 66. The terminal ends of the second elongate edge 66 are further reinforced using a corner hinge 70 in the area of the locator pin 59 which overlies that portion of the tape hinge 69. The second elongate edge 66 of the rear sheet 62 extends outwardly beyond the second elongate edge 56 of the front panel 51 in a connector tab 71 for attachment to the lower panel 13 of the display structure 10. The connector tab has a magnetic strip 72 affixed therealong for attachment to a mating magnetic strip 82 on the lower panel 13.

Thus, as assembled the upper column 12 may be attached between a pair of columns 20 by placing the respective locator pins 34, 35 in the mating U-shaped recesses 36 locating the upper column 12 therefor at the top of each respective column 20. The stiffening strip 57 of the upper column 12 thence attaches to the edge strip 27, outer magnetic strip 53 and locates and stabilizes the adjoining edges along their length. The lower panel 13 is formed from a rectangular sheet of a suitable material, and is preferably formed from a flexible plastic. A top edge magnetic strip 82 runs along the top edge 83 of the lower panel 13. Similarly, side edge magnetic strips 84 extend along the side edges 85 of the lower panel 13. The lower panel 13 thus may be placed covering the opening defined between the two columns 20 and below the top column 12 by mating its top edge 83 magnetic strip 82 with the connector tab 71 magnetic strip 72 and allowing the retention therealong and mating the side magnetic strips 84 with the respective column outer magnetic strips 43. This will thus retain the lower panel 13 in a fixed location while the display panel 10 is in use.

I have found that the difference in width between the curved sheet and the flat sheet may be varied over a reasonable range, although the preferred results are achieved when the curved sheet is substantially about 15 percent to 60 percent greater in width than the flat sheet. The outward bow of the curved sheet tends to sag or deform when the ratio of widths is increased. In one embodiment which has achieved the desired results, a front sheet 21 having a width dimension of approximately 12 inches was utilized with a curved rear sheet 22 having a width dimension of approximately 19 inches and an outward bow was achieved where the rear sheet 22 was displaced from the front sheet a distance of about six inches. This construction appeared to produce a relatively rigid shape for the support column 20, and support column 20 retained this shape while being handled and supporting a portable display. After attachment of a display panel surface 11 the support column 20 retained a rigid vertical appearance and gave the perception of a strong column supporting the end of the display surface 11. It is believed that the outwardly-bowed rear sheet 22 creates an outward tension on the front sheet 21, thereby tending to retain the front sheet 21 in a flat position, and thereby prestressing the column 20 so that the vertical loading caused by the display panel surface 11 thereby transfers the loading stress through the column as a tension stress, unless the column 20 is overloaded so as to cause a compression stress and buckling of the sheets 21 or 22. I have found that the best results occur when the front sheet 21 is somewhat thinner than the rear sheet 22, for example, when front sheet 21 has a thickness of about 0.020 inches and rear sheet 22 has a thickness of about 0.040 inches.

In the preferred embodiment of my invention, sheets 21 and 22 may be constructed from polycarbonate plastic sheet material, having a thickness of about 0.010 to 0.050 inches. In one embodiment of my invention, it is expected that graphics will be incorporated by a printing process across front sheet 21 which provides an elongate surface for presenting the graphics. In another embodiment of my invention either front sheet 21 or rear sheet 22 or both sheets may be constructed from a translucent plastic sheet material to permit light from a light source contained within the support column 20 to radiate through the sheets. When the front sheet 21 is translucent and illuminated, it may be used to provide indirect lighting for the display panel 11 or when graphics are also included upon its surface to backlight the graphics. When the rear sheet 22 is constructed of a translucent material it may be illuminated to provide the effect of a "glowing" column. Similarly, when the rear sheet 22 is translucent it may also include graphic information printed thereon and the illumination will thusly illuminate and draw attention to the graphics.

The use of translucent sheeting to form the front sheet 21 or the rear sheet 22 is particularly valuable when used in a field setup where the lighting provided is either inadequate, or harsh, or otherwise not aesthetically pleasant. In this type of environment, the support columns 20 may be illuminated from within by selecting the proper lighting fixtures to provide one of several appearances. One such appearance, would comprise the use of a translucent front panel 21 to provide soft-warm illumination to the display panel 11 to negate the effects of the sharp-harsh lighting of the environment. Another example would be the use of the translucent rear sheet 22 which is illuminated to provide the illusion of an apparently "glowing" column to draw additional attention to the display structure 10.

In operation, the portable display panel 11 is erected in its normal and ordinary fashion, depending on the particular type of support structure being used. Each vertical support column 20 is removed from a storage container such as a round elongate tube and unrolled to a flat position along a floor surface. Each support column is then assembled by wrapping the rear sheet 22 around and causing it to bow outwardly from the front sheet 21 and aligning the magnetic strips 33 and 31 to adhere. During this phase, the locater pin 34 is also mated with the mating U-shaped recess 36 to properly locate the front sheet 21 with respect to the rear sheet 22. The magnetic strips 33 and 31 are then, if need be, pressed together to ensure adequate adhesion along their contact surface. This operation is repeated for the second support column 20.

The top column 12 can similarly be assembled by removing its front sheet 51 and rear sheet 52 from storage, aligning the respective first edges 55, 65 and inserting the locator pins 59 and the respective U-shape recesses 67 thereby allowing the respective first magnetic strips 53, 63 to adhere along their length. The rear sheet 52 is then bowed outwardly and the respective second elongate edges 56, 66 are brought together. The second side locator pins 59 are thence placed in the respective U-shape recesses 67 locating the corners of the second edge 56 of the rear sheet 52 with respect to the second edge 66 of the front sheet 51. This brings the respective second magnetic strips 54, 64 into contact where they will adhere.

The upper column 12 may be thence attached between the two columns 20 by aligning the locator pins 34 with the respective U-shape recesses 36 and sliding the locator pins 34 therein. As thus placed, this will bring the stiffener strip 57 proximate the column tab 27 outer magnetic strip 43 where they will adhere together. After the one column 20 has been attached, the second column 20 is thence likewise attached to the opposite end of the upper column 12. The display 10 lower panel 13 may be thence placed in the opening described by mating its top edge magnetic strips 82 with the top column 12 connecting tab 71 magnetic strip 72 to locate the top edge 83 of the lower panel 13. The side edges 85 of the lower panel 13 are thence allowed to fall having their respective magnetic strips 84 brought into contact with the column 20 outer edge magnetic strips 43 to locate the display panel the desired location.

Assembled display structure 10 then may be placed on a suitable support surface 37 and if so equipped, removably attached to the display surface 37 by placing a spring clamp 40 over the hold-down flaps 38 thereby locating the entire display structure 10 in its selected location upon the display surface 37.

It is understood that the upper column 12 front panel 51 by being totally detachable from its respective rear sheet 52 may be substituted by an equivalent front sheet 51 when the advertising or marketing need changes so as to warrant the use of a different panel. Similarly, the lower panel 13 of the display structure 10 may be substituted by another similarly shaped and magnetically attachable panel allowing its change as advertising and marketing needs change.

Thusly, the two columns 20 and the upper column 12 rear sheet 52 may be used to support for display a plurality of front sheets 51 and lower panels 13 limited only by the ingenuity of the user.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A lightweight portable support for supporting at least a flexible display, comprising (a) a first and second vertical column, each column having a first flat sheet of flexible material of first predetermined width and elongate length, a second sheet of flexible material of second predetermined width greater than said first predetermined width, and elongate length, and means for attaching said first sheet to said second sheet along respective edges of said elongate length whereby said second sheet is affixed to and bowed outwardly from said first sheet;

(b) a third column having a first flat sheet of flexible material of first predetermined width and second elongate length, a second sheet of flexible material of second predetermined width greater than said first predetermined width, and second elongate length; and (c) means for attaching respective elongate ends of said third column to respective elongate edges of said first and second vertical columns, whereby said third column is attached horizontally between said first and second vertical columns.

2. The apparatus of claim 1, further comprising means for attaching a flexible display panel along respective elongate edges of said first, second and third columns.

3. The apparatus of claim 2, wherein said means for attaching further comprises magnetic strips respectively affixed along said elongate edges and respectively affixed along the edges of said flexible display panel.

4. The apparatus of claim 2, wherein said third column first flat sheet is constructed of light-translucent material.

5. The apparatus of claim 1, wherein said means for attaching respective elongate ends of said third column further comprises a rigid plate affixed to respective elongate ends of said first sheet, with a pin projecting from said plate, and a slot in each of said first and second vertical columns' first sheet for receiving said pin.

6. The apparatus of claim 1, wherein each of said means for attaching said first sheet to said second sheet respectively comprise a magnetic strip affixed along said elongate edge of said first sheet and a magnetic strip affixed along said elongate edge of said second sheet.

7. The apparatus of claim 1, wherein said first and second columns further comprise a hold-down flap hingedly attached along the first predetermined width of each of said first flat sheets.

8. A lightweight portable display support adapted for easy assembly to support a panel display comprising a horizontal column supported between two vertical columns, wherein each column is constructed of two sheets, comprising a first sheet of flexible material of a predetermined width and an elongate length; a second sheet of flexible material of a second predetermined width, greater than said first width, and an elongate length; means for attaching said first sheet to said second sheet along respective edges of said elongate length, whereby said second sheet is affixed to and bowed outwardly from said sheet; means for attaching said display along the elongate length of said sheet.

9. The apparatus of claim 7, wherein said second sheet is constructed of translucent material.

10. The apparatus of claim 8, wherein said second sheet is thicker than said first sheet.

11. The apparatus of claim 9, wherein said first and second sheets are constructed of polycarbonate material.

12. The apparatus of claim 7, wherein said means for attachment along at least one pair of respective elongate edges further comprises magnetic strips affixed along said edges.

13. The apparatus of claim 11, wherein said means for attaching said display along the elongate length further comprises a magnetic strip disposed along an elongate length edge and a second magnetic strip disposed along the display edge.

14. The apparatus of claim 12, wherein said second sheet is constructed of translucent material.

15. A lightweight portable display support adapted for supporting portable display panels, comprising a horizontal column supported between two vertical columns, wherein each column is constructed of two sheets, comprising a first sheet of flexible material having an elongate length and a relatively smaller and predetermined first width, said first sheet having gripping material along respective elongate edges; a second sheet of flexible material having an elongate length and a relatively smaller and predetermined second width, said second width being greater than said first width, and second sheet having gripping material along respective elongate edges adapted to releasably adhere to the gripping material along respective elongate edges of said first sheet, whereby said first and second sheets may be releasably adhered together along respective elongate edges with said second sheet bowed outwardly from said first sheet; and a means for removably attaching said display structure coterminous with said releasably adhered elongate edges.

16. The apparatus of claim 14, wherein said second width is at least 15 percent greater than said first width.

17. The apparatus of claim 14, wherein said second sheet is constructed of translucent material.

18. The apparatus of claim 14, wherein the means for removably attaching said display structure further comprises a mechanical connecting means for attachment of said display structure.

19. A portable display support formed from flexible sheet material, comprising a horizontal column supported between two vertical columns, wherein each column is constructed of:

(a) a first sheet of flexible material of generally rectangular shape, having means for adhesive attachment disposed along a first two respectively parallel edges; said edges being spaced apart by a first predetermined distance;

(b) a second sheet of flexible material having at least two parallel edges spaced apart a second predetermined distance, larger than said first predetermined distance, and having means for adhesive attachment disposed along said parallel edges, and (c) an attachment means disposed on at least one of said parallel edges.

20. The apparatus of claim 18, wherein said first and second sheets further comprise sheets of flexible plastic material.

21. The apparatus of claim 19, wherein said second predetermined distance is from 15–60 percent greater than said first predetermined distance.

22. The apparatus of claim 20, wherein said means for adhesive attachment further comprises a magnetic strip.

23. The apparatus of claim 21, wherein said second sheet further comprises a light-translucent material.

24. The apparatus of claim 22, wherein said first and second sheets are each about 0.020 inches in thickness.

* * * * *